US005341773A

United States Patent [19]

Schulte et al.

[11] Patent Number: 5,341,773

[45] Date of Patent: Aug. 30, 1994

[54] JOINT FOR AN AUTOMATIVE AIR INDUCTION SYSTEM

[75] Inventors: Paul J. Schulte, Ann Arbor; Catherine A. Gandolfo, Plymouth, both of Mich.

[73] Assignee: Ford Motor Company, Dearborn, Mich.

[21] Appl. No.: 145,552

[22] Filed: Nov. 4, 1993

[51] Int. Cl.[5] ..... F02M 35/10

[52] U.S. Cl. ..... 123/184.61; 285/305

[58] Field of Search ..... 123/403, 337, 52 MC, 123/52 M; 285/305

[56] References Cited

U.S. PATENT DOCUMENTS

| | | | |
|---|---|---|---|
| 2,772,898 | 12/1956 | Seeler | 285/305 |
| 3,149,362 | 9/1964 | Smithson | 285/305 |
| 3,471,186 | 10/1969 | Luebert et al. | 285/305 |
| 3,584,902 | 6/1971 | Vyse | 285/305 |
| 4,431,218 | 2/1984 | Paul, Jr. et al. | 285/305 |
| 4,776,313 | 10/1988 | Freismuth et al. | 123/52 M |
| 4,805,564 | 2/1989 | Hudson | 123/52 MC |
| 4,894,156 | 1/1990 | Murken | 285/305 |
| 5,158,045 | 10/1992 | Arthur et al. | 123/337 |
| 5,188,078 | 2/1993 | Tamaki | 123/52 MC |
| 5,219,185 | 6/1993 | Oddenino | 285/305 |
| 5,271,646 | 12/1993 | Allread et al. | 285/305 |

*Primary Examiner*—David A. Okonsky

*Attorney, Agent, or Firm*—David B. Kelley; Roger L. May

[57] ABSTRACT

An automotive engine induction system has a throttle body and a manifold made of plastic composite material joined together by sliding a cylindrical sleeve extending from the throttle body into an opening in the manifold. Two lugs on the throttle body engage keyed slots on the manifold to provide positive angular and linear alignment, and two O-rings between the throttle and manifold seal the joint. A U-shaped pin fits through holes in the keyed slots to hold the lugs therein and snaps into a retainer clip incorporated on either the manifold or throttle body, thus providing an unstressed joint not susceptible to load relaxation of the sealing surface.

13 Claims, 4 Drawing Sheets

JOINT FOR AN AUTOMATIVE AIR INDUCTION SYSTEM

FIELD OF THE INVENTION

The present invention relates to an air induction system for an internal combustion engine, and, more particularly, to a joint for connecting a throttle body to the manifold of an engine which avoids load induced relaxation of the sealing surface.

BACKGROUND OF THE INVENTION

Automotive air induction systems typically include an intake manifold having runners leading to the engine cylinders. As shown in FIG. 10, throttle body 30, which contains a throttle valve (not shown) for controlling the flow of air into intake manifold 10, is attached to manifold inlet 18. Traditionally, threaded fasteners are used to mount throttle body 30 to manifold inlet 18, with a flat gasket (not shown) placed therebetween to obtain a proper seal. For example, bolts 82 screwed through connecting plate 80 attach throttle body 30 to manifold 18 (FIG. 10).

A problem arises because stress relaxation of the sealing surfaces may render it difficult to maintain a sufficient sealing load on the gasket when the joints described above are used with plastic composite assemblies. Stress relaxation results when the load applied to ensure proper sealing causes the plastic composite material to deform. As use of plastic composites for the manifold and throttle body becomes increasingly common, new ways of ensuring a proper seal have become necessary. One such way is to provide receptacles in the intake manifold having metal fittings for receiving bolts. Problems with this type of joint, however, are that it can be difficult to assemble and expensive to manufacture.

SUMMARY OF THE INVENTION

The present invention overcomes the problems inherent in prior throttle body to manifold joints as applied to plastic composite components by providing an air induction system in which a non-stressed joint is formed between a manifold and a throttle body. The air induction system has a throttle means for selectively throttling flow into the engine comprising a throttle body having a throttle valve therein and a sleeve extending therefrom, with the sleeve having at least one lug thereon. The manifold has an opening for receiving the sleeve and has at least one slot for receiving the lug(s) to provide positive angular and axial location for the sleeve relative to the opening. Means for retaining the lugs within the slots are provided, so that an unstressed joint is formed between the throttle body and the manifold.

In a preferred embodiment, the sleeve has means for sealing thereon, and also has two lugs thereon circumferentially spaced 180° apart. The manifold has two keyed slots positioned in the manifold for receiving the two lugs to provide positive angular location for the sleeve relative to an axis perpendicular to the plane of the opening. The means for retaining the lugs within the slots comprises a pin having two legs and a cross member, with one of the legs fitted through an aperture in one of the slots and the other of the legs fitted through an aperture in the other of the slots so as to hold the lugs therein in positive axial location relative an axis perpendicular to the opening. The cross member detachably mounts to a retaining clip on the manifold so that an unstressed joint is formed between the throttle body and the manifold.

Thus, an object of the present invention is to provide a joint for attaching a throttle body to the manifold, both made of plastic composites, which avoids load relaxation while maintaining a good seal between the components.

Another object of the present invention is to provide means for forming a minimally stressed joint between a throttle body and the manifold.

A further object of the present invention is to provide an easy to assemble joint for attaching a throttle body to the manifold of an engine.

DETAILED DESCRIPTION OF THE PREFERRED EMBODIMENT

Figure 9:
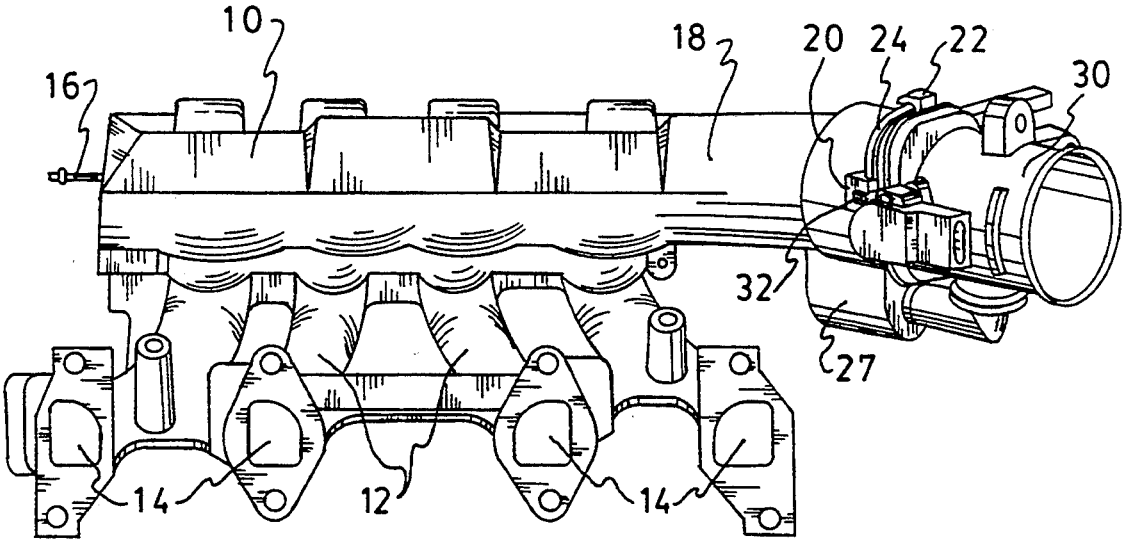
FIG. 9 is a perspective view of an engine intake manifold having an inlet connected to a throttle body by a joint according to the present invention.
Figure 10:
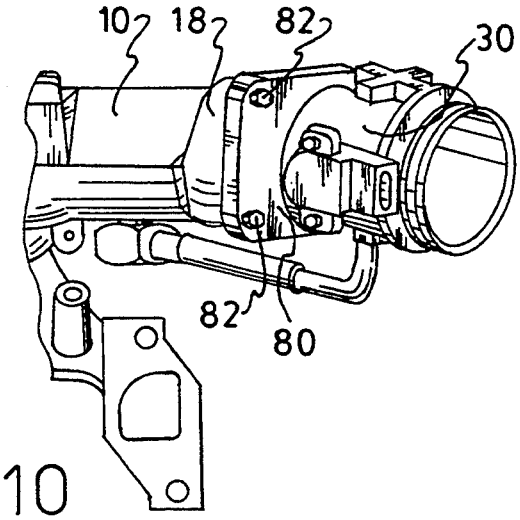
FIG-10 PRIOR ART
FIG. 10 is a partial perspective of a manifold inlet connected to a throttle body by a prior art joint.

Referring now to FIG. 9, a perspective view of intake manifold 10 of the present invention has runners 12 leading to outlet ports 14 for supplying an air/fuel mixture to the cylinders of an engine (not shown). Intake manifold 10 is preferably made of a plastic composite, such as glass filled nylon. Manifold inlet 18 connects intake manifold 10 with a throttle body 30 which throttles flow therethrough, preferably with a butterfly valve. The joint between manifold inlet 18 and throttle body 30 is made by keyed slot 20, retaining clip 22, locking pin 24 and lug 32, as is more clearly seen in FIG. 1.

Figure 2:
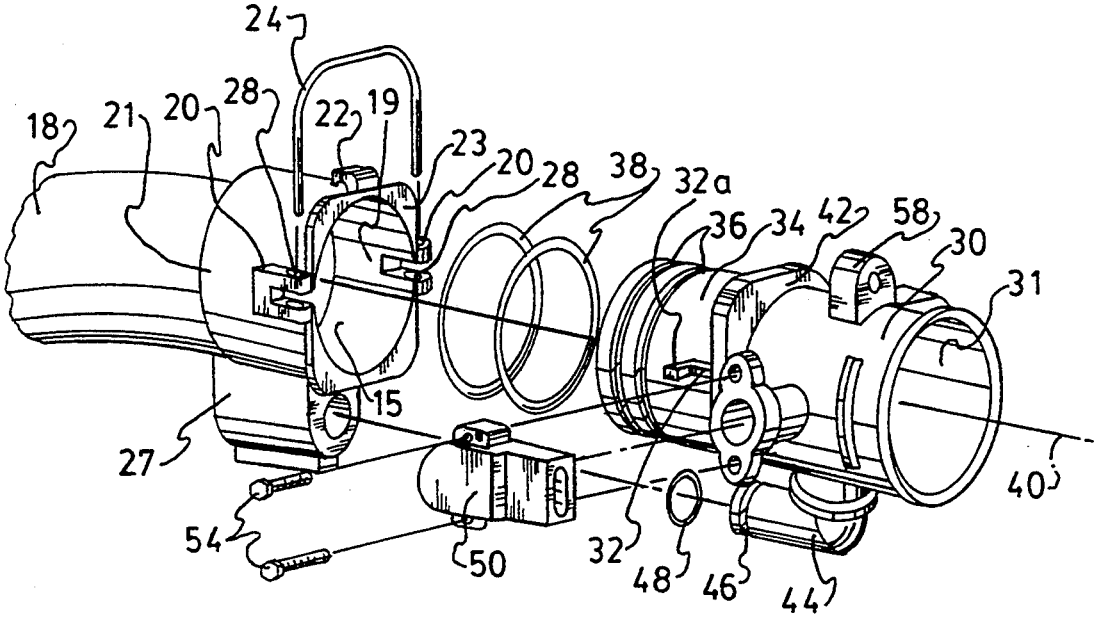
FIG. 2 is an expanded perspective view of the throttle body-to-manifold joint shown in FIG. 1.
Figure 4:
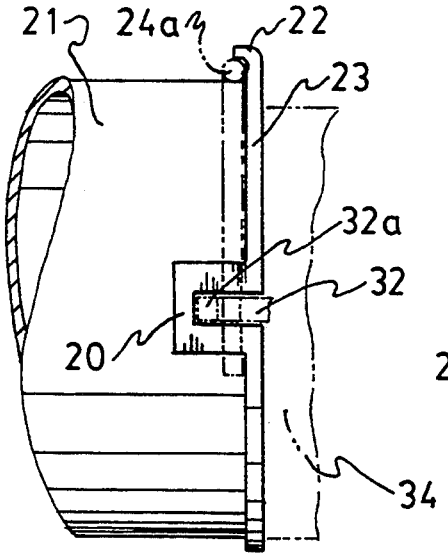
FIG. 4 is a side view of the joint of the present invention showing a locking pin in the locked position and clipped to a retaining clip so that a lug on the sleeve of the throttle body is secured within a keyed slot on the manifold inlet to obtain positive angular and axial location of the throttle body relative the manifold inlet.
Figure 3:
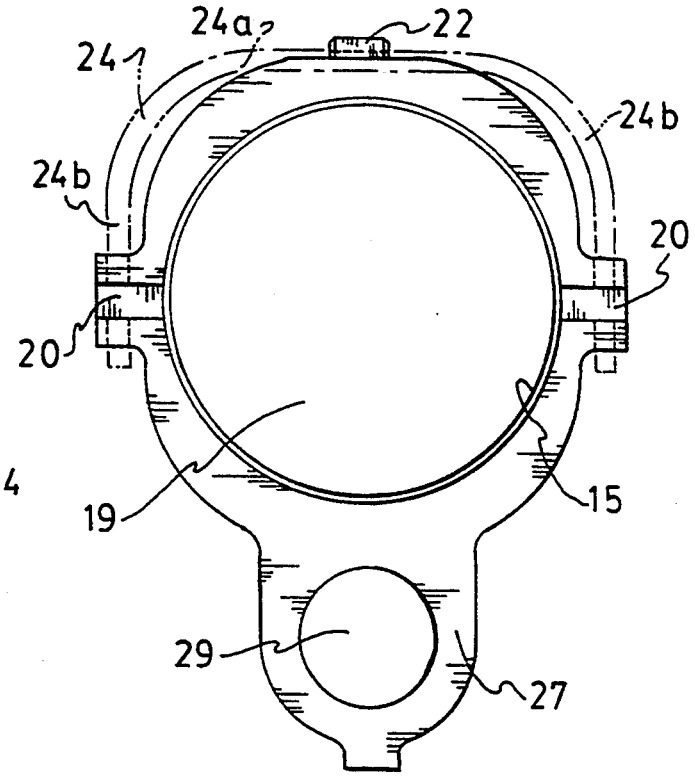
FIG. 3 is an end view of the manifold inlet of the present invention showing the relative position of the retaining pin.
Figure 5:
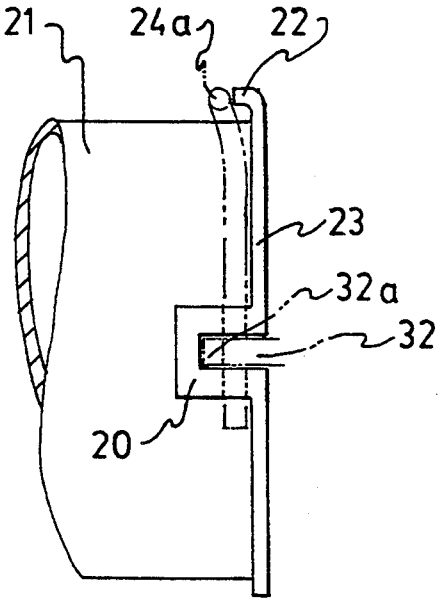
FIG. 5 is a side view of the joint of the present invention similar to FIG. 4 showing a locking pin in the unclipped position but securing a lug on the sleeve of the throttle body within a keyed slot on the manifold inlet.

FIG. 2 shows an expanded view of the joint between manifold inlet 18 and throttle body 30. Manifold inlet 18 has opening 19 leading to shoulder bore 15 within shoulder 21. Shoulder 21 has plate 23 for mating with flange 42 of throttle body 30. Keyed slots 20 on shoulder 21 are positioned 180° apart around a center axis, 40, which is perpendicular to the plane of opening 19. Apertures 28 in keyed slots 20 provide a path for locking pin 24 to retain throttle body lugs 32 in keyed slots 20. Locking pin 24 has legs **24*b* which fit into apertures 28 (FIG. 3). Cross member 24*a* detachably mounts under retaining clip 22 as legs 24*b* slide through apertures 28** (FIGS. 4 and 5).

Figure 6:
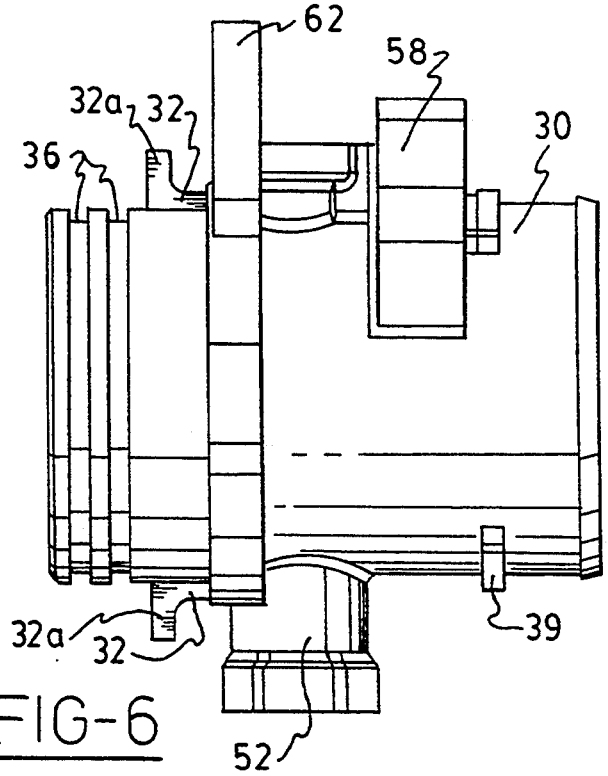
FIG. 6 is a top view of a throttle body according to the present invention showing a sleeve having lugs thereon which fit into keyed slots on the manifold inlet and grooves for receiving 0-rings.
Figure 8:
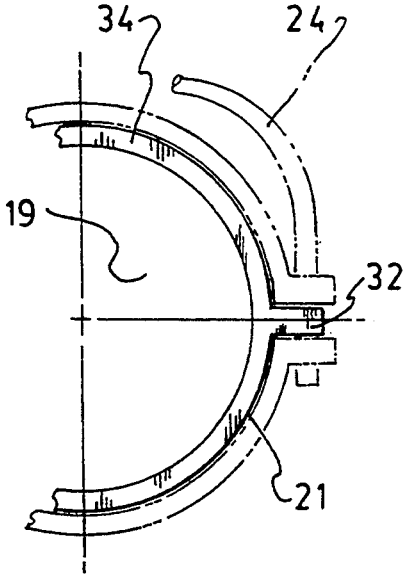
FIG. 8 is a partial end view of the throttle body of FIG. 6 showing location of the throttle body sleeve and lug with respect to the manifold inlet, keyed slot, and locking pin (shown in partially dotted lines).

Throttle body 30, preferably having a generally cylindrical bore 31 along center axis 40, has flange 42 from which sleeve 34 extends in an axial direction toward opening 19 of manifold inlet 18 (FIG. 2). Annular sleeve grooves 36 provide a seat for O-rings 38, which preferably are made of nitrile rubber or viton, and mate with bore 15 to seal the joint. Alternatively, annular shoulder ledge 17 in bore 15 mates with O-rings 38 in a known manner (FIG. 3) to seal the joint. Returning to FIG. 2, lugs 32 on sleeve 34 abut flange 42 and extend radially outward from the surface of sleeve 34. Lug ears **32*a*, which engage keyed slots 20 as described below, extend from lugs 32. Lugs 32 are oriented 180° apart around center axis 40** (FIG. 6).

Figure 7:
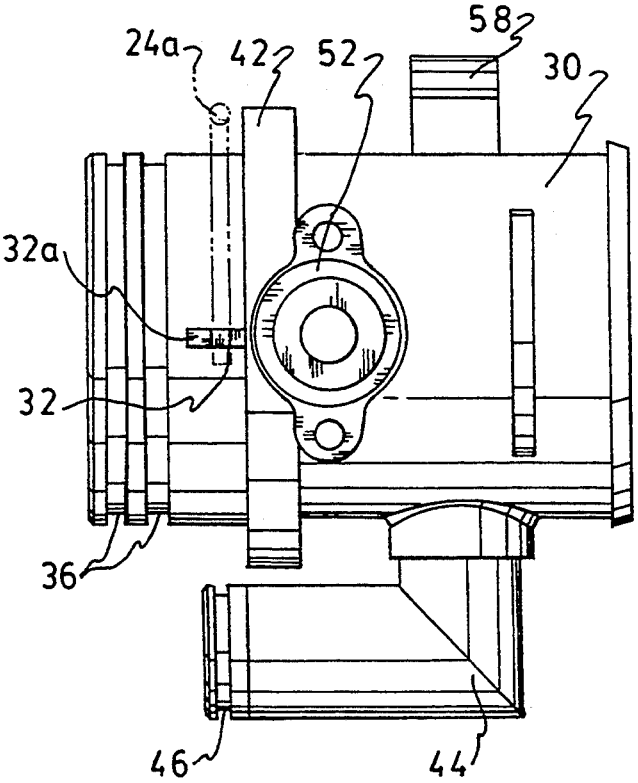
FIG. 7 is a side view of the throttle body of FIG. 6.

An air by-pass tube 44 descends from cylindrical conduit 31 at a location axially opposite sleeve grooves 36 from sensor flange 52 (FIG. 7). Tube 44 bends 90° and runs parallel to center axis 40 in the direction of manifold inlet 18. By-pass tube groove 46 receives O-ring 48 for making a seal with by-pass boss 27 (FIG. 2). Boss 27 is attached to manifold inlet 18 and is rotationally aligned with air by-pass tube 44 relative to center axis 40. Conduit 29 within boss 27 receives by-pass tube 44 (FIGS. 2 and 3) thus providing a path for flow around the throttle valve (not shown) in throttle body 30 for providing additional idle when needed.

Figure 1:
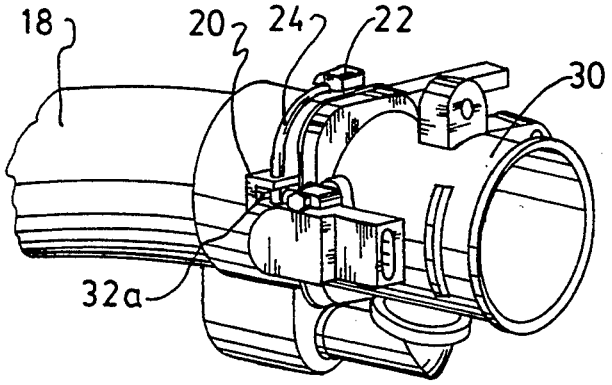
FIG. 1 is a perspective view of a joint according to the present invention showing a throttle body joined to an intake manifold.

A throttle position sensor 50 is attached to sensor flange 52 with screws 54 as shown in FIG. 2. Throttle body 30 has accelerator mounting bracket 58 for connection with the acceleration lever (not shown), as shown in FIGS. 1, 6 and 7. Accelerator lever stop 62 provides a means for limiting movement of the acceleration lever.

With manifold inlet 18 and throttle body 30 just described, assembly can be accomplished easily as follows (FIG. 2). O-rings 38 are seated within grooves 36 on sleeve 34 of throttle body 30 and O-ring 48 is seated on groove 46 of by-pass tube 44. Sleeve 34 is slid into bore 15 of shoulder 21 on manifold inlet 18 until plate 23 of shoulder 21 mates with flange 42 of throttle body 30. O-rings 38 seat against bore 15 to provide a seal between the inside diameter of shoulder 21 and sleeve 34.

As sleeve 34 is fitted within shoulder 21, lugs 32 are oriented such that lug ears **32*a* engage keyed slots 20, as shown in FIG. 2. Sleeve 34 is thus fixed rotationally about center axis 40 with respect to shoulder 21. When sleeve 34 is fully inserted into shoulder 21, lug ears 32*a* allow legs 24*b* of locking pin 24 to pass through apertures 28 and prevent lug ears 32*a* from disengaging from keyed slots 20, thus fixing sleeve 34 in an axial position along center axis 40 relative to shoulder 21 (FIG. 4). Positive angular and axial location of throttle body 30 with respect to manifold inlet 18 is thereby achieved. Locking pin 24 is retained in the locking position by snapping cross member 24*a* of locking pin 24 under retaining clip 22, which preferably is an integral part of shoulder 21, as shown in FIGS. 1 and 5. Retaining clip 22 can alternatively be located on throttle body 30, for example, on flange 42**.

In a preferred embodiment, the size of lug ears **32*a* differ. FIG. 4 shows lug ear 32*a* and FIG. 5 shows a larger lug ear 32*a*. This size differential allows easier assembly since the larger size lug ear 32*a* will only fit into a larger keyed slot 20 (FIG. 5). As a result, throttle body 30 will be correctly joined to manifold inlet 18**.

Sleeve 34 of throttle body 30 and bore 15 of shoulder 21 are dimensioned so as to fit closely together, with O-rings 38 providing a seal therebetween. Locking pin 24 serves to retain lug ears **32*a* in place and does not serve to clamp shoulder 21 to sleeve 34. With such an assembly, a well sealed yet unstressed joint is formed between manifold inlet 18 and throttle body 30**.

Throttle body 30 and associated components preferably are integrally molded as one piece of glass filled polyphenylene sulfide (PPS), or other plastic material, such as acetyl, or non-plastic materials known to those skilled in the art and suggested by this disclosure. Alternately, air by-pass tube 44 can be a separate part, also made of PPS, which is spin-welded to throttle body 30. Locking pin 24, preferably having a "U" shape, is preferably made of a metallic material, such as spring steel, and is capable of resiliently bending to engage retaining clip 22 as described above.

Although the preferred embodiment of the present invention has been disclosed, various changes and modifications may be made without departing from the scope of the invention as set forth in the appended claims.

We claim:

1. An air induction system for an internal combustion engine comprising:

throttle means for selectively throttling flow into said engine comprising a throttle body having a throttle valve therein and a sleeve extending therefrom, said sleeve having at least one lug thereon;

a manifold having an opening for receiving said sleeve and having at least one slot for receiving said at least one lug to provide positive location for said sleeve relative to said opening; and means for retaining said at least one lug in said at least one slot so that an unstressed joint is formed between said throttle body and said manifold.

2. An air induction system according to claim 1 wherein said means for retaining comprises a pin fitted through an aperture in said at least one slot and in said at least one lug and detachably mounted to a retaining clip on said manifold.

3. An air induction system according to claim 2 wherein said retainer clip is positioned on said throttle body.

4. An air induction system according to claim 1 wherein said throttle body and said manifold are made of a plastic composite material.

5. An air induction system according to claim 1 wherein said throttle body is made from glass filled polyphenylene sulfide and said manifold is made of glass filled nylon.

6. An air induction system according to claim 1 wherein said sleeve is cylindrical in shape and wherein said opening is circular in shape.

7. An air induction system according to claim 1 wherein said sleeve has means for sealing said joint.

8. An air induction system according to claim 7 wherein said means for sealing comprises at least one O-ring fitted in at least one annular groove on said sleeve.

9. An air induction system for an internal combustion engine comprising:

throttle means for selectively throttling flow into said engine comprising a throttle body having a throttle valve therein and an annular sleeve extending therefrom having means for sealing thereon, said sleeve also having two lugs circumferentially spaced 180° apart thereon;

an intake manifold having an opening for receiving said sleeve and having two keyed slots positioned in said manifold for receiving said two lugs to provide positive angular location for said sleeve relative to an axis perpendicular to the plane of said opening; and means for retaining said lugs within said slots comprising a pin having two legs and a cross member, with one of said legs fitted through an aperture in one of said slots and the other of said legs fitted through an aperture in the other of said slots so as to hold said lugs therein in positive linear location relative to an axis perpendicular to said opening, said cross member detachably mounted to a retaining clip on said manifold so that an unstressed joint is formed between said throttle body and said manifold.

10. An air induction system according to claim 9 wherein said throttle body and said manifold are made of a plastic composite material.

11. An air induction system according to claim 9 wherein said retainer clip is positioned on said throttle body.

12. An air induction system according to claim 9 wherein one of said slots is larger than the other of said slots, and one of said lugs is larger than the other of said lugs.

13. An air induction system according to claim 9 wherein said means for sealing comprises at least one O-ring fitted in at least one annular groove on said sleeve.

* * * * *